United States Patent [19]

Ogawa

[11] 4,081,795

[45] Mar. 28, 1978

[54] APPARATUS AND METHOD FOR DETECTING THE OCCURRENCE OF AN ALARM CONDITION

[75] Inventor: Francis T. Ogawa, Lakewood, Colo.

[73] Assignee: Statitrol Corporation, Lakewood, Colo.

[21] Appl. No.: 721,838

[22] Filed: Sep. 9, 1976

[51] Int. Cl.[2] ..... G08B 17/10

[52] U.S. Cl. ..... 340/237 S; 250/381

[58] Field of Search ..... 340/237 S; 250/381, 250/382, 384, 385

[56] References Cited

U.S. PATENT DOCUMENTS

| | | | |
|---|---|---|---|
| 3,798,625 | 3/1974 | McMillian et al. | 340/237 S |
| 3,801,972 | 4/1974 | Ho Kim et al. | 340/237 S X |
| 3,842,409 | 10/1974 | Mayer | 340/237 S X |
| 3,866,195 | 2/1975 | Ried, Jr. | 340/237 S |
| 3,906,474 | 9/1975 | Lehsten | 340/237 S |

*Primary Examiner*—John W. Caldwell, Sr.
*Assistant Examiner*—Daniel Myer
*Attorney, Agent, or Firm*—Max L. Wymore

[57] ABSTRACT

An alarm condition detection apparatus and method is embodied in the form of a combustion products detector for detecting fire. The detector generates a difference voltage signal proportional to the degree of combustion products in the atmosphere being monitored. The difference signal is employed to generate an alarm signal to indicate when the condition reaches an alarm state. The detector is adjustable to control the level of a reference voltage which in turn controls the difference signal voltage change needed to cause generation of an alarm signal. Thereby, detector sensitivity is set. The detector includes circuitry operable to generate in response to the difference signal a series of perceptible pulses having a pulse rate proportional to the magnitude of the difference signal. Thereby, with the condition normal, the pulse rate provides a perceptible indication of detector sensitivity. Further, the pulse rate change occurring as the condition approaches alarm state provides a perceptible indication of the approach. Additionally, the detector may be arranged so that a change in the difference signal to a predetermined trouble level causes a trouble signal to be generated to indicate low operating voltage, component failure, or improper sensitivity setting. Alarms may be included or associated with the detector for indicating occurrence of the alarm condition and/or to indicate trouble.

15 Claims, 1 Drawing Figure

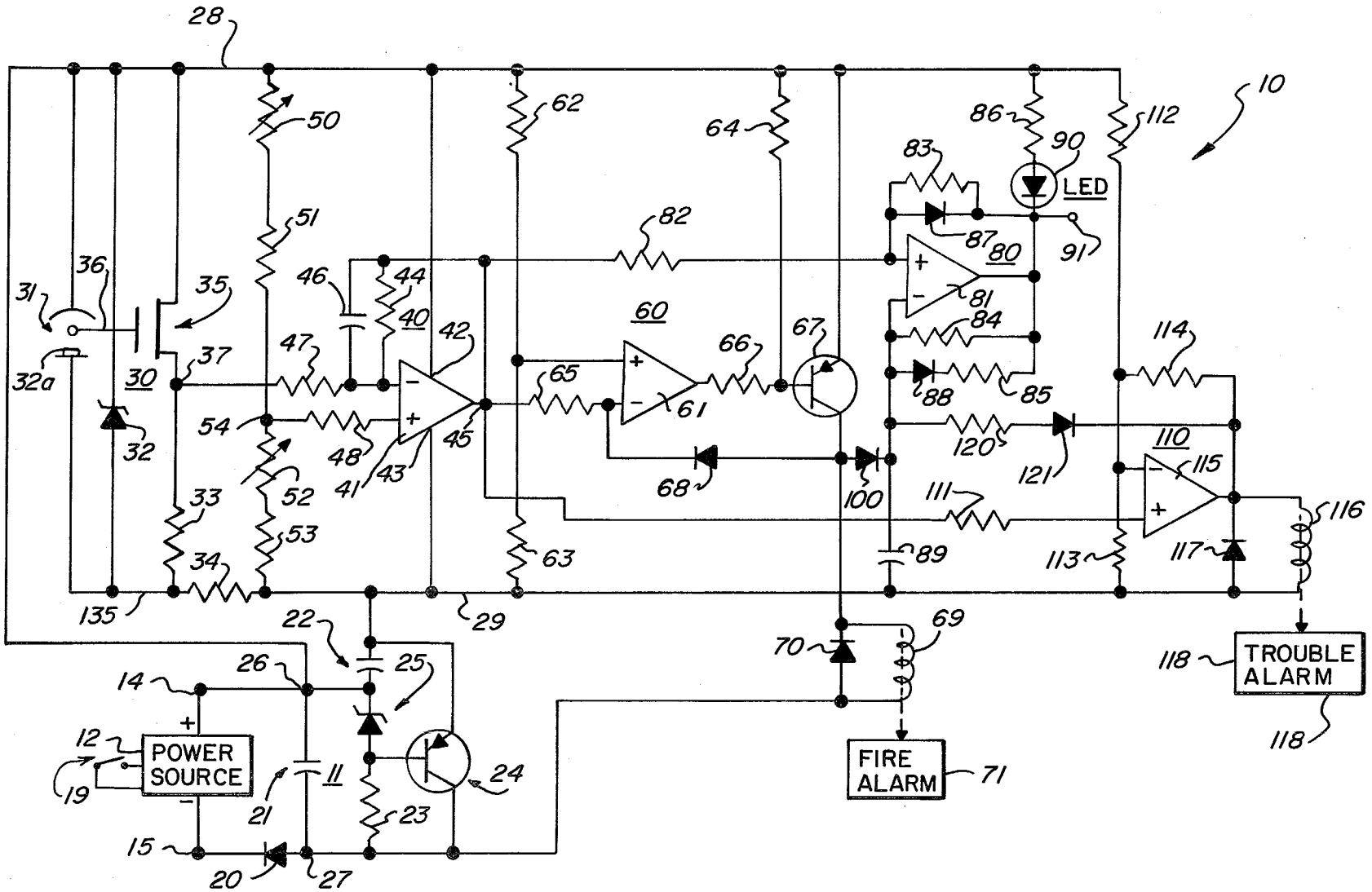
TROUBLE ALARM
FIRE ALARM
LED
POWER SOURCE

APPARATUS AND METHOD FOR DETECTING THE OCCURRENCE OF AN ALARM CONDITION

BACKGROUND OF THE INVENTION

The present invention relates to the detection of the occurrence of an alarm condition, such as the occurrence of fire as indicated by the presence of smoke and other combustion products in the atmosphere. More particularly, the present invention relates to an improved apparatus and method for detecting the occurrence of such an alarm condition.

SUMMARY OF THE INVENTION

It is an object of the present invention to provide an improved apparatus and method for detecting the occurrence of an alarm condition; for example, fire as indicated by the presence of a predetermined degree of smoke and combustion products in the atmosphere.

It is also an object of the present invention to provide an improved apparatus for detecting the occurrence of such an alarm condition capable of being preset or adjusted to have a selected sensitivity while simultaneously indicating the sensitivity setting.

It is additionally an object of the present invention to provide an improved alarm condition detection apparatus as set forth capable of indicating a decrease in apparatus sensitivity caused by low operating voltage, component failure or improper adjustment.

It is another object of the present invention to provide an improved alarm condition detection apparatus as set forth capable of generating an alarm signal whenever the condition being sensed reaches an alarm point as well as a trouble signal whenever low operating voltage, component failure and/or improper adjustment prevent proper operation.

It is yet another object of the present invention to provide an improved alarm detection apparatus as set forth capable of pulsing an indicator device, such as an LED (light emitting diode) or its equivalent, to generate a signal made up of perceptible pulses, the frequency or pulse rate of which is a perceptible indication of apparatus sensitivity as long as the condition being monitored is at substantially normal level and the frequency of which changes in a predetermined sense as the condition changes from normal state to provide a perceptible indication of approach of the condition towards an alarm point.

It is still another object of the present invention to provide an improved apparatus and method for detecting an alarm condition characterized by employing the frequency or pulse rate of a series of perceptible pulses, such as the flashing on and off of an LED or its equivalent, as an indication of apparatus sensitivity as long as the condition being monitored by the apparatus is substantially at normal level and which employs change in frequency of the series of pulses in a predetermined sense to indicate change of the condition from normal level towards an alarm point.

In accomplishing these and other objects, there is provided in accordance with the present invention apparatus for detecting the occurrence of an alarm condition. The apparatus is illustrated in the form of a smoke or combustion products detector for detecting the occurrence of a fire.

The detector operates to generate a difference voltage signal porportional to the degree of smoke and combustion products present in atmosphere being monitored. In response to the difference signal reaching a predetermined alarm level, which alarm level corresponds to a sufficiently high degree of smoke or combustion products in the atmosphere being monitored to indicate fire, the detector generates an alarm signal for actuating a fire or condition alarm. The fire alarm may be incorporated in the detector or associated therewith.

The detector is adjustable to control the level of a reference voltage. The reference voltage in turn determines the difference signal voltage change needed to cause generation of the alarm signal, thereby to control or set detector sensitivity. Included in the detector is circuitry operable to generate in response to the difference signal a series of perceptible pulses having a pulse rate proportional to the magnitude of the difference signal. Thereby, with the degree of smoke and combustion products in the atmosphere substantially in a normal state, i.e., zero or negligible, the pulse rate of the series of pulses provides a perceptible indication of the detector'a sensitivity. Further, the change in pulse rate occurring as the degree of smoke and combustion products in the atmosphere increases provides a perceptible indication of approach of the condition towards an alarm state. As used herein, the term "perceptible" means capable of being perceived by the human senses, e.g. visually, audibly, etc. Preferably, the perceptible pulses constitute flashes of light emitted from an LED, or an equivalent indicator arrangement, and the LED is preferably driven by a voltage controlled oscillator arrangement (VCO), the VCO itself being driven by the difference signal.

Also, the detector may be arranged so that a change in the difference signal to a predetermined trouble level, opposite in sense from the level change associated with approach of the condition towards alarm state, indicates low power supply voltage or level, component failure or improper adjustment. In response to the difference signal reaching this predetermined trouble level, the detector may be arranged to generate a trouble signal for actuating a trouble alarm, which alarm may be included therein or associated therewith. This feature may be of particular importance when the detector power supply is a battery since the charge and output level of a battery power source declines with age.

Additional objects of the present invention reside in the specific construction of the exemplary detector apparatus hereinafter particularly described in the specification and shown in the drawing, and its method of operation.

BRIEF DESCRIPTION OF THE DRAWING

The single FIGURE drawing is a circuit diagram of a combustion products detector according to the present invention.

DETAILED DESCRIPTION OF THE PREFERRED EMBODIMENT

Referring to the drawing in more detail, there is shown an alarm condition detection apparatus in the form of a smoke or combustion products detector. The combustion products detector is generally identified by the numeral 10 and is for detecting the occurrence of fire by sensing the degree of smoke and combustion products in the atmosphere.

The detector 10 is powered by a power supply circuit 11 connected to a power source 12. The power source 12 has positive and negative output terminals, respectively, which are connected to power supply circuit input terminals 14 and 15.

The power source 12 may supply either AC or DC voltage at a selected level, such as 24 volts, and may be formed by a voltage step-down transformer connected to receive a standard line voltage. For example, a five to one voltage step-down transformer could be used to transformer 120 VAC line voltage of 24 VAC. The primary winding of the voltage step-down transformer would be connected to the AC line voltage while the secondary winding would be connected to the power supply input terminals 14, 15.

The power supply circuit 11 is made up of diode 20; capacitors 21, 22; resistor 23; PNP transistor 24; and a zener diode 25. The diode 20 functions with a DC power source 12 to protect the circuitry of the detector 10, from DC voltage of the wrong polarity. With an AC power source 12, the diode 20 operates to half-wave rectify the AC voltage being supplied. The capacitor 21 is included in the power supply circuit 11 to provide a filter when an AC power source 12 is employed. The capacitor 21 filters the AC signal half-wave rectified by the diode 20 to provide a relatively smooth DC voltage across circuit points 26, 27.

The transistor 24, capacitor 22, resistor 23 and zener diode 25 provide a voltage regulator to convert the DC voltage on power supply circuit points 26, 27 into a regulated DC supply voltage. The regulated DC supply voltage is supplied to voltage buses 28, 29. The voltage on the voltage bus 28 is designated common for the detector circuit 10. The level on the bus 29 is set by the zener diode 25, feeder resistor 23 and transistor 24 at a predetermined voltage level below common, such as 15 VDC below. In the voltage regulator circuitry of the power supply 11, the capacitor 22 functions to filter out any high frequency oscillations from its regulated DC output.

The detector 10 has condition sensing circuitry 30 for monitoring the degree of smoke and combustion products in the atmosphere and generating a DC voltage signal proportional thereto. The sensing circuitry 30 includes a conventional ion chamber 31, a zener diode 32, resistors 33, 34 and a field effect transistor (FET) 35.

In the sensing circuitry 30, the voltage applied across the ion chamber 31 and FET 35 is set and regulated by the voltage dropping resistor 34 and the zener diode 32 to be at a predetermined level less than the DC potential difference between the voltage buses 28 and 29. For example, with the voltage bus 29 at 15 VDC below common, the zener diode 32 and voltage dropping resistor 34 may be selected to set the voltage bus 135 10 VDC below common.

In operation of the condition sensing circuitry 30, the ion chamber 31, which may use as a radiation source Americium 241, operates to control electrical current flow therethrough as a function of the clarity of the air or atmosphere being monitored therein. When the atmosphere is in a clear state, i.e., zero or negligible combustion products present, the current flow through the ion chamber is maximum and the voltage signal generated on ion chamber output terminal 36 is at a so-called normal level. Upon the occurrence of a fire, however, smoke and combustion products will commence to fill the air being monitored, thereby increasing the electrical resistance of the ion chamber to current flow therethrough. As a consequence, the ion chamber output voltage generated on terminal 36 proportionately decreases from its normal clear state level as the degree of combustion products present in the atmosphere being monitored increases.

The FET 35 is connected as a voltage follower and receives the ion chamber output signal on its gate electrode. In response to the ion chamber output signal received, the FET 35 operates to generate across its load resistor 33 on a circuit point 37 as a condition signal a voltage directly porportional to the ion chamber output signal. It is noted that the magnitude of the condition signal generated on point 37 varies inversely as the degree of the condition being monitored approaches alarm state, that is to say, as the level of smoke and combustion products in the atmosphere being monitored increases, the magnitude of the condition voltage decreases by approaching the voltage level on bus 135.

The detector 10 has a buffer amplifier circuit arrangement 40 connected to receive as one input the condition signal and as another input a selected voltage as a reference signal. The buffer amplifier arrangement 40 generates from these two inputs a difference signal as an output. The difference signal, hereinafter explained, is used to generate both trouble and alarm signals and to indicate detector sensitivity when the atmosphere being monitored is in clear or normal state.

The buffer amplifier arrangement 40 includes an operational amplifier 41 having a non-inverting input designated by a "plus" and an inverting input designated by a "minus." Bias voltage is supplied to the amplifier 41 in a conventional manner at terminals 42 and 43. A feedback resistor 44 is connected between the amplifier output terminal 45 and its inverting input to control amplifier gain. A capacitor 46 is connected in parallel with the resistor 44 to stabilize the output of amplifier 41 by filtering high frequency components therefrom.

As aforementioned, the buffer amplifier circuit arrangement 40 receives as inputs the condition signal and a selected voltage as a reference signal. The condition signal and reference signal are applied, respectively, through coupling resistors 47 and 48 to the inverting and non-inverting input terminals of the operational amplifier 41.

The reference signal is a DC voltage signal generated by a voltage divider network formed by resistors 50–53. The resistors 50–53 are connected in series in the order listed between the voltage buses 28 and 29, and the voltage divider formed thereby defines at the junction between the resistors 51 and 52 an output point 54 upon which the reference signal is generated. The resistor 48, which couples the reference signal to the non-inverting input of amplifier 41, is connected to the circuit point 54.

In the voltage divider formed by the resistors 50–53, the resistors 50 and 52 are both variable resistors. By adjusting the resistance of either of these resistors, the magnitude of the DC reference voltage appearing on circuit point 54 may be selectively controlled. The magnitude of the variable resistor 52 is substantially larger than that of the variable resistor 50. The setting of the resistor 52 is generally set at the factory and this control is termed the compensation control. The variable resistor 50 serves as a fine adjustment or sensitivity control for controlling the level of the reference voltage on circuit point 54.

The setting of the reference voltage by selectively adjusting the resistor 50 controls the detection sensitivity of the detector 10. In the detector 10, the reference voltage is set to have a value a predetermined amount more positive than the voltage level of the condition signal generated when the atmosphere being monitored by the ion chamber 31 is in a clear or normal state. As a consequence, the difference between the condition signal and reference voltage increases as the level of smoke and combustion products in the atmosphere increases since the condition signal in such case goes more negative.

The operational amplifier 41 operates to generate an amplified difference signal proportional to the difference between the condition signal and the reference signal. This amplified difference signal is generated on its terminal 45 and is supplied therefrom to the inverting terminal (designated by a "minus") of operational amplifier 61 and the non-inverting terminal (designated by a "plus") of operational amplifier 81.

The operational amplifier 61 forms part of an alarm circuit 60. In addition to the amplifier 61, the alarm circuit 60 is made up of biasing resistors 62–64, coupling resistors 65–66, a PNP transistor 67, a latching diode 68 and a relay coil 69 connected in parallel with a diode 70 for suppressing inductive voltage spikes. Associated with the relay coil 69 is a fire alarm 71.

In operation of the alarm circuit 60, the non-inverting input (designated by a "plus") of the amplifier 61 is set by means of the voltage divider formed by the resistors 62, 63 at a selected voltage level higher than the difference signal output of the amplifier 41 generated when the atmosphere being monitored by the ion chamber 31 is in normal or clear condition. As a smoke condition develops to indicate fire, i.e., the degree of smoke and combustion products in the atmosphere monitored by the ion chamber 31 increases, the difference signal output of amplifier 41 increases until an alarm point is reached where at the difference signal level applied to the inverting input of the amplifier 61 exceeds the DC voltage set on its non-inverting input. When this alarm point is reached, the polarity of the output of the amplifier 61 changes, thereby to bias the collector to emitter current path of the transistor switch provided by the transistor 67 into conduction. Conduction of the transistor 67 simultaneously forward biases the latching diode 68 and energizes the relay coil 69.

Energization of the coil 69 actuates the fire alarm 71 to indicate the occurrence of a fire. The latching diode 68, which is connected between the collector terminal of the transistor switch 67 and the inverting input of the amplifier 61 operates to apply a feedback voltage sufficient to bias the inverting input of the amplifier 61 positive with respect to its non-inverting input, thereby to latch the amplifier 61 and alarm circuit 60 in an alarm state.

The amplifier 61 may be selectively unlatched to reset the alarm circuit 60 to its unlatched state and fire alarm 71 to a non-alarm state by interrupting the power supplied to the detector 10. This may be accomplished through conventional on-off switch means incorporated in the power source 12. These conventional switch means are generally indicated in the drawing by a switch 19 shown on the power source 12.

The aforementioned operational amplifier 81 which also receives on its non-inverting input the difference signal voltage generated by the amplifier 41 forms part of a voltage controlled oscillator (VCO) 80. The VCO 80 is formed by resistors 82–86; diodes 87–88; and a capacitor 89; and is connected to drive or pulse a light emitting diode (LED) 90 by the electrical pulses generated on output point 91.

In operation of the VCO 80, the difference signal voltage is applied to the non-inverting input of amplifier 81 through coupling resistor 82. For purposes of explanation, the capacitor 89, which is connected between voltage bus 29 and the inverting input (designated "minus") of the amplifier 81, is assumed at this time to be in a discharged or low voltage state. As a consequence, the difference voltage signal on the non-inverting input of the amplifier 81 exceeds that applied by the capacitor 89 to its inverting and a high output is generated on the amplifier output terminal, i.e., circuit point 91, which biases LED 90 in a non-conductive state and causes the capacitor 89 to charge through resistor 84. The output on circuit point 91 further maintains the amplifier 81 biased in this high state as a result of the positive feedback signal applied through resistor 83 to the amplifier's non-inverting input.

The capacitor 89 is charged until the voltage thereon exceeds the signal applied to the non-inverting terminal of the amplifier 81. When the difference signal is at normal level, i.e., corresponding to the normal or clear state of the atmosphere being monitored by the smoke detector, it may, for example, take approximately 970 milliseconds for the voltage of the capacitor 89 to be charged to a level exceeding the voltage on the non-inverting amplifier input. When such occurs, the output of the amplifier 81 drops sharply with the result that the diode 87 clamps the non-inverting input of the amplifier 81 low.

Upon drop of the output of amplifier 81 to a low state, the capacitor 89 is discharged through the current path defined by the diode 88 and resistor 85 to discharge the capacitor 89 to its low voltage state. During this interval, the LED 90 is energized by current flow through the resistor 86. This brief time interval may, for example, be 30 milliseconds. Once the capacitor 89 is discharged to its low voltage state, the voltage applied to the inverting input of the amplifier 81 drops below the level of the signal on its non-inverting input with the result that the amplifier output again goes high. Upon the output of the amplifier 81 going high or positive, the diode 87 ceases to conduct and the LED 90 is biased off in a non-conductive state.

It is noted that as the magnitude of the difference signal generated by amplifier 41 increases, which occurs as smoke and combustion products increase in the atmosphere being monitored by the ion chamber 31, the time necessary to charge the capacitor 89 to a voltage exceeding that on the non-inverting input of the amplifier 81 proportionally increases. As a consequence, it is apparent that the frequency of the VCO 80 and the rate at which the LED 90 is pulsed to emit light is inversely proportional to the magnitude of the difference signal.

With the atmosphere being monitored by the ion chamber 31 in a normal or clear state, the pulse rate of the VCO 80 is indicative of the detector sensitivity as set by the voltage divider network formed by resistors 50–53. This is the case because the level of the difference signal being generated at this time is at a reference level corresponding to the setting of the sensitivity control resistor 50. The LED 90 which is being pulsed at the VCO frequency thus provides a series of perceptible pulses, i.e., flashes of emitted light, the pulse rate of which indicates for an operator the sensitivity of the detector 10 to smoke and combustion products. By increasing the magnitude of the reference level of the difference signal, the sensitivity of the detector may be increased since a smaller increase in the magnitude of difference signal is necessary to reach the alarm level at which the alarm circuit 60 is actuated. Such increase in detector sensitivity is reflected by a decrease in the pulse rate of the VCO 80 and flashing LED 90. To decrease the sensitivity of the detector 10, the reference level of the difference signal is decreased in magnitude by appropriately setting the variable resistor 50. Such decrease in detector sensitivity is reflected by an increase in the pulse rate of the series of perceptible pulses generated by the LED 90.

In operation of the detector 10 as smoke and combustion products increase in the atmosphere, the pulse rate of the LED 90 drops from the condition normal rate, thereby to also provide a perceptible indication of the approach of the condition towards an alarm state. Further, a diode 100 is connected between the collector electrode of the transistor 67 in the alarm circuit 60 and the inverting input of VCO amplifier 81. This diode 100 operates to lock the amplifier 81 at low output and the LED 90 is energized in a continuously on state upon the latching of the alarm circuit 60 in its alarm state.

In a detector 10 constructed in accordance with the present invention a suitable LED pulse rate for indicating condition alarm level was found to be 40 pulses per second. In the same detector constructed, the reference or condition normal level was designed to have a median LED pulse rate of 60 pulses per second. The specific LED pulse rate corresponding to condition normal level varied, naturally, from this 60 pulse per second rate as a function of the sensitivity setting of the detector 10. That is to say, when the detector 10 was set to be more sensitive than its median setting, the LED pulse rate was less than 60 pulses per second while when the detector was set to be less sensitivity than this median sensitivity setting, the reverse was true.

The detector 10 additionally includes a trouble circuit 110 formed by resistors 111–114, an operational amplifier 115 and a relay coil 116 having a diode 117 associated therewith for suppressing inductive voltage spikes. A trouble alarm 118 is associated with trouble circuit 110 which is actuated by de-energization of the relay coil 116.

In operation of the trouble circuit 110, the inverting input of the amplifier 115 (designated by a "minus") is set at a predetermined level by the voltage divider formed by resistors 112, 113 and the difference signal generated as the output of amplifier 41 is applied through coupling resistor 111 to the amplifier's non-inverting input (designated by a "plus"). With the atmosphere being monitored in normal state, the reference level of the difference signal is greater than the voltage applied to the non-inverting input of amplifier 115. As a consequence, the output of the amplifier 115 is high and holds the coil 116 energized. With the coil 116 energized, the trouble alarm 118 is in its non-alarm state. The resistor 114 connected in the trouble circuit 110 functions as a feedback resistor for controlling the gain of the amplifier 115.

When the difference signal being monitored by the trouble circuit 110 drops to a voltage level insufficient to properly operate the detector 10, the differential input of amplifier 115 changes polarity. As a consequence, the output of the amplifier 115 goes low and the relay coil 116 de-energizes with the result that the trouble alarm 118 is energized. The trouble circuit 110 thereby operates by monitoring the difference signal level to supervise the operation of the FET 35, the adjustment of the sensitivity control 50, and the effective voltage level supplied by the power supply 11 and power source 12. It is noted that such undue decrease in the difference voltage generated on circuit point 45 caused by trouble in the detector circuit 10 also appears and is reflected as an increase in the pulse rate of the LED 90 and that such a pulse rate increase inherently indicates decrease in the detector sensitivity.

It is noted that in the detector 10 aforementioned as being constructed in accordance with the present invention the circuitry was designed so that the pulse rate of the LED 90 increased to approximately 75 pulses per second when the difference signal dropped to the so-called trouble level. It is further noted a resistor 120 and diode 121 are connected in series between the output terminal of the trouble amplifier 115 and the inverting input of VCO amplifier 81. Thereby, the VCO 80 is disabled whenever the output of the trouble amplifier 115 goes low since the diode 121 becomes forward biased and clamps the capacitor 89 in a discharged state.

Additionally, it is pointed out that the compensation control provided by the variable resistor 52 permits wider variation of the difference signal than obtainable by adjusting the sensitivity control 50 so as to permit checking of the VCO 80 and LED 90 pulse rates at the detector's trouble and alarm thresholds.

Thus, there has been provided an improved apparatus and method for detecting the occurrence of an alarm condition embodied in the form of a smoke or combustion products detector for detecting the occurrence of a fire. Although the invention has been described herein in what is conceived to be its preferred embodiment, it is recognized that departures may be made therefrom within the scope of the invention.

What is claimed is:

1. In apparatus for detecting the change of a selected condition from a normal to an alarm state in which the change in level of a difference signal which varies as a function of the degree of said condition is employed to generate an alarm signal to indicate that the degree of said condition has reached alarm state, the improvement in combination therewith of:

means for selectively setting the change in said difference signal level needed to generate said alarm signal whereby to control apparatus sensitivity;

means having an unlatched and latched state responsive to said difference signal for generating perceptible signals, said perceptible signal generating means being operable in its unlatched state to generate a variable output in the form of a series of perceptible pulses having a pulse rate proportional to the magnitude of said difference signal, said perceptible signal generating means latching in its latched state in response to the level of said difference signal reaching the level corresponding to the degree of said condition reaching an alarm state and being operable in its latched state to generate a non-varying output; and, means for selectively resetting said perceptible signal generating means to its unlatched state whereby with said perceptible signal generating means set in its unlatched state the pulse rate of said series of pulses functions to provide a perceptible indication of apparatus sensitivity when the degree of said condition is substantially in a normal state and a perceptible indication of the approach of alarm state as the degree of said condition changes from normal to alarm state.

2. The invention defined in claim 1, wherein:

said difference signal is a voltage signal;

said perceptible signal generating means includes voltage controlled oscillator means and indicator means, said oscillator means having an unlatched and latched state, said oscillator means latching in its latched state in response to said difference signal reaching the level corresponding to the degree of said condition reaching an alarm state and being disabled in its latched state, said oscillator means in its unlatched state being responsive to said difference signal to generate a series of electrical pulses having a pulse rate proportional to the magnitude of said difference signal, said indicator means being driven by said oscillator means and being operable in response to said series of electrical pulses to generate said series of perceptible pulses in substantial time correspondence therewith; and, said resetting means is operable to selectively reset and enable said oscillator means.

3. The invention defined in claim 2, wherein said indicator means is light emitting diode means.

4. The invention defined in claim 3, wherein:

the magnitude of said difference signal is directly proportional to the degree of said condition;

the pulse rate of said series of electrical pulses generated by said oscillator means in its unlatched state is inversely proportional to the magnitude of said difference signal; and, said oscillator means in its disabled state biases said light emitting diode means in its light emitting state.

5. The invention defined in claim 4, wherein said apparatus is for detecting the occurrence of fire and includes an ion chamber means for detecting the presence and degree of smoke and combustion products in the atmosphere.

6. The invention defined in claim 5, wherein:

said apparatus is powered by voltage supply means;

the magnnitude of said difference signal is inversely proportional to the voltage level supplied by said voltage supply means; and, including:

means responsive to said difference signal for generating a trouble signal whenever said difference signal reaches a predetermined trouble level to indicate that the level of voltage supplied by said voltage supply means has dropped too low for proper operation, the magnitude of said difference signal in changing to said trouble level changing in the sense opposite to that occurring as a result of the change of the degree of said condition from normal towards alarm state.

7. The invention defined in claim 6, including:

means responsive to said alarm signal for indicating the occurrence of an alarm condition; and, means responsive to said trouble signal for indicating trouble in the operation of said apparatus.

8. The invention defined in claim 1, wherein said perceptible pulses generated by said perceptible signal generating means in its unlatched state are light pulses.

9. The invention defined in claim 1, wherein:

the magnitude of said difference signal is directly proportional to the degree of said condition; and, the pulse rate of said series of perceptible pulses generated by said perceptible signal generating means in its unlatched state is inversely proportional to the magnitude of said difference signal.

10. The invention defined in claim 9, wherein:

said perceptible pulses generated by said perceptible signal generating means in its unlatched state are light pulses; and, said non-varying output generated by said perceptible signal generating means in its latched state is a light signal.

11. The invention defined in claim 10, wherein said apparatus is for detecting the occurrence of fire and includes ion chamber means for detecting the presence and degree of smoke and combustion products in the atmosphere.

12. The invention defined in claim 1, wherein said apparatus is for detecting the occurrence of fire and includes ion chamber means for detecting the presence and degree of smoke and combustion products in the atmosphere.

13. The invention defined in claim 1, wherein:

the magnitude of said difference signal is directly proportional to the degree of said condition;

said apparatus is powered by voltage supply means;

the magnitude of said difference signal is directly proportional to the voltage level supplied by said voltage supply means; and, including:

means responsive to said difference signal for generating whenever said difference signal reaches a predetermined trouble level a trouble signal to indicate that the level of voltage supplied by said voltage supply means has dropped too low for proper operation, the magnitude of said difference signal in changing to said trouble level changing in the sense opposite to that occurring as a result of the change of the degree of said condition from normal towards alarm state.

14. The invention defined in claim 13, including:

means responsive to said alarm signal for indicating the occurrence of an alarm condition; and, means responsive to said trouble signal for indicating trouble in the operation of said apparatus.

15. The invention defined in claim 1, including means responsive to said alarm signal for indicating the occurrence of an alarm condition.

* * * * *